US011346335B2

(12) United States Patent
Echter et al.

(10) Patent No.: US 11,346,335 B2
(45) Date of Patent: May 31, 2022

(54) FLEXIBLE SUPPLY GAS ROUTING FOR GAS COMPRESSORS

(71) Applicant: ONBOARD DYNAMICS LLC, Bend, OR (US)

(72) Inventors: Nicholas Paul Echter, Fort Collins, CO (US); Kristina Weyer-Geigel, Yakima, WA (US)

(73) Assignee: Onboard Dynamics LLC, Bend, OR (US)

( * ) Notice: Subject to any disclaimer, the term of this patent is extended or adjusted under 35 U.S.C. 154(b) by 91 days.

(21) Appl. No.: 16/611,835

(22) PCT Filed: May 21, 2018

(86) PCT No.: PCT/US2018/033592
§ 371 (c)(1),
(2) Date: Nov. 7, 2019

(87) PCT Pub. No.: WO2018/217594
PCT Pub. Date: Nov. 29, 2018

(65) Prior Publication Data

US 2020/0191131 A1 Jun. 18, 2020

Related U.S. Application Data

(60) Provisional application No. 62/509,403, filed on May 22, 2017.

(51) Int. Cl.
*F04B 49/00* (2006.01)
*F04B 25/00* (2006.01)
(Continued)

(52) U.S. Cl.
CPC ..... *F04B 49/007* (2013.01); *F04B 25/00* (2013.01); *F04B 27/00* (2013.01); *F04B 27/24* (2013.01);
(Continued)

(58) Field of Classification Search
CPC ..... F04B 25/00–27/24; F04B 49/22; F04B 49/225; F04B 49/03; F04B 49/24;
(Continued)

(56) References Cited

U.S. PATENT DOCUMENTS 4,781,164 A 11/1988 Seeber et al.
5,400,751 A * 3/1995 Grimmer ..... F16F 15/32 123/192.2

(Continued)

OTHER PUBLICATIONS

International Search Report and Written Opinion issued on International Application No. PCT/US2018/033592, dated Aug. 23, 2018, 8 pages.

*Primary Examiner* — Bryan M Lettman
(74) *Attorney, Agent, or Firm* — Leber IP Law; Shelly M. Fujikawa

(57) ABSTRACT

Most multistage compressors specify a maximum inlet pressure that may be supplied to the compressor to stay within designed limits. If the supply gas to be compressed is at a higher pressure than the specified maximum inlet pressure, then its pressure must be reduced before connecting it to the compressor. This pressure reduction is inefficient. The present invention avoids reducing the inlet pressure by routing the supply gas directly to the appropriate compression stage depending on its inlet pressure such that the compressor loads are still within the specified limits of the equipment.

18 Claims, 1 Drawing Sheet

(51) Int. Cl.

| | |
|---|---|
| ***F04B 27/24*** | (2006.01) |
| ***F04B 39/10*** | (2006.01) |
| ***F04B 41/04*** | (2006.01) |
| ***F04B 49/035*** | (2006.01) |
| ***F04B 35/00*** | (2006.01) |
| ***F04B 49/24*** | (2006.01) |
| ***F04B 27/00*** | (2006.01) |

(52) U.S. Cl.
CPC ..... *F04B 35/002* (2013.01); *F04B 39/10* (2013.01); *F04B 41/04* (2013.01); *F04B 49/002* (2013.01); *F04B 49/035* (2013.01); *F04B 49/24* (2013.01)

(58) Field of Classification Search
CPC ..... F04B 49/035; F04B 49/002; F04B 27/00; F04B 27/005; F04B 1/00–1/34; F04B 7/00–7/06; F04B 49/022; F04B 49/08; F04B 2205/01; F04B 2205/02; F04B 2205/015; F04B 2205/16; F04B 41/04; F04B 49/007; F04B 35/002; F04B 39/10
USPC ..... 417/531, 532
See application file for complete search history.

(56) References Cited

U.S. PATENT DOCUMENTS

| | | | | |
|---|---|---|---|---|
| 5,947,697 | A * | 9/1999 | Morrison | F04B 39/1046 417/237 |
| 6,340,013 | B1 | 1/2002 | Britton | |
| 6,695,591 | B2 | 2/2004 | Grimmer et al. | |
| 6,904,752 | B2 | 6/2005 | Foster et al. | |
| 2004/0065308 | A1 | 4/2004 | Bryant | |
| 2007/0079778 | A1* | 4/2007 | Atkinson | F04B 35/002 123/62 |
| 2013/0280095 | A1* | 10/2013 | Worden | F04B 49/10 417/1 |
| 2015/0285182 | A1* | 10/2015 | Hagen | F02M 21/0218 123/193.3 |
| 2016/0185473 | A1* | 6/2016 | Zucchini | F04B 25/00 417/53 |

* cited by examiner

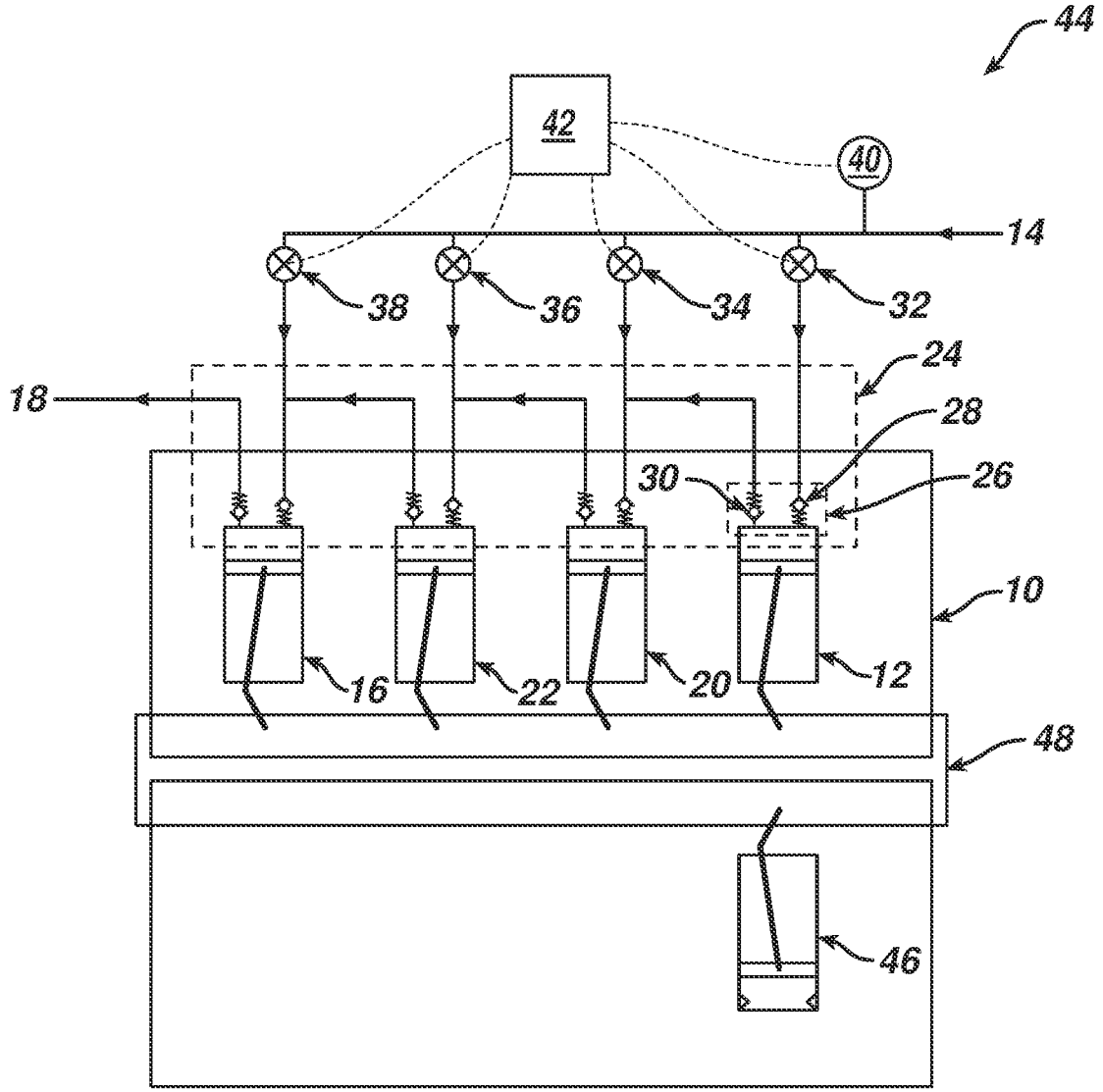
44
42
40
14
38
36
34
32
24
18
28
30
26
10
16
22
20
12
48
46

FLEXIBLE SUPPLY GAS ROUTING FOR GAS COMPRESSORS

STATEMENT REGARDING FEDERALLY SPONSORED RESEARCH OR DEVELOPMENT

This invention was made with government support under DE-AR0000490 awarded by the U.S. Department of Energy. The government has certain rights in the invention.

BACKGROUND

Natural gas is an attractive fuel for vehicles due to its low cost and reduced emissions, including greenhouse gases. However, for effective use as a vehicle fuel, natural gas must be compressed to high pressure.

One type of gas compressor utilizes an internal combustion engine containing a plurality of compression cylinders, at least one standard combustion cylinder to drive the plurality of compression cylinders, and a common crankshaft coupling the plurality of compression cylinders and the at least one standard combustion cylinder. The compression cylinders are in fluid communication with each other.

During a gas compression cycle, gas travels from a gas inlet, through a check valve, to an initial compression cylinder and is compressed. Another check valve allows the compressed gas to flow out of the initial compression cylinder through a third check valve and into another compression cylinder. The gas is serially compressed in stages until it leaves the final compression cylinder to the gas outlet for use as fuel. U.S. Pat. No. 5,400,751, incorporated by reference herein, provides further details regarding natural gas compressors.

Most of these multistage compressors specify a maximum inlet pressure that may be supplied to the compressor to stay within designed power, flow rate, heat-rejection and pressure limits. If the supply gas to be compressed is at a higher pressure than the specified maximum inlet pressure, then its pressure must be reduced before connecting it to the compressor. Usually this requires the installation of an external pressure regulator, which is undesirable for the additional hardware and work for the operator. Additionally, reducing the pressure upstream of the compressor is also inefficient, as the higher pressure of the gas supply is lost when it is regulated down to match the compressor's maximum inlet pressure, and it requires compressor work to compress the gas back to the initial supply pressure. To avoid reducing the inlet pressure, often compressors are designed for a specific location with a specific inlet pressure, which limits the design for use in other locations.

SUMMARY

The present invention provides a way to avoid reducing the supply gas pressure when the supply gas pressure exceeds the maximum inlet pressure.

One way to avoid reducing the supply gas pressure is by providing a gas compressor including: (a) a plurality of compression cylinders in fluid communication with each other, configured to compress a gas in at least two gas compression stages, including an initial compression cylinder in fluid communication with a gas inlet and a final compression cylinder in fluid communication with a gas outlet, wherein at least two of the compression cylinders from different gas compression stages are in fluid communication with the gas inlet and have different maximum inlet pressures; and (b) one or more valves disposed between the gas inlet and the at least two compression cylinders to deliver gas from the gas inlet to only a single stage at one time.

This gas compressor may then be used in a method of delivering gas to the gas compressor including closing the one or more valves such that no gas flows into the gas compression cylinders; providing a supply gas having an inlet pressure at the gas inlet; and opening the valve corresponding to the compression cylinder that has a maximum inlet pressure greater than or equal to the inlet pressure of the supply gas to route the supply gas from the inlet to that compression cylinder.

DESCRIPTION OF THE DRAWING

FIG. 1 is a schematic for a four cylinder gas compressor with flexible supply gas routing.

DETAILED DESCRIPTION

The present invention allows for a much wider range of inlet pressures for a gas compressor. Rather than consistently routing the supply gas to the first stage, the supply gas is directly routed to the appropriate compression stage depending on its inlet pressure such that the compressor loads are still within the specified limits of the equipment.

FIG. 1 is a schematic of a four cylinder gas compressor 10 that directly routes supply gas to the appropriate compression stage based on its inlet pressure. The compressor 10 includes a plurality of compression cylinders in fluid communication with each other: an initial compression cylinder 12, a final compression cylinder 16 in fluid communication with a gas outlet 18, and optional intermediate cylinders such as intermediate cylinders 20 and 22. A cylinder head 24 includes a valve system 26 to regulate the flow of gas into and out of the compression cylinders. The flow of gas into each compression cylinder may be regulated using a check valve, e.g., check valve 28. The flow of gas out of the compression cylinder may be regulated using a check valve, e.g., check valve 30. The compressor 10 may be in the form of a modified internal combustion engine 44, and may have one or more combustion cylinders 46 (not shown) that are operated to power compression via a common crankshaft 48 coupling the one or more combustion cylinders 46 and the plurality of compression cylinders.

FIG. 1 shows all of the compression cylinders 12, 20, 22, and 16 in fluid communication with gas inlet 14. Valves 32, 34, 36, and 38 are disposed between gas inlet 14 and each of the compression cylinders 12, 20, 22, and 16, respectively. Sensor 40 is disposed between gas inlet 14 and valves 32, 34, 36, and 38. Electronic controller 42 accepts input from sensor 40 and provides input to valves 32, 34, 36, and 38.

Prior to a gas compression cycle, all valves disposed between gas inlet 14 and the compression cylinders are closed such that no gas flows to the gas compressor. Gas is then supplied at gas inlet 14 and the inlet pressure is determined using sensor 40. If the supply pressure is sufficiently low to allow inlet gas to be routed to initial compression cylinder 12, then valve 32 is opened, and the rest of the valves 34, 36, and 38 are closed. If the supply pressure is higher, then the supply gas is routed to the appropriate stage by leaving valve 32 closed, and opening only the valve for the appropriate higher stage corresponding to a compression cylinder that may accommodate the supply pressure, e.g., the compression cylinder that has a maximum inlet pressure greater than or equal to the inlet pressure of the supply gas. Thus, only a single stage would receive the supply gas at a given time (i.e., in FIG. 1, only one of valves 32, 34, 36, or 38 would be open at a time). With this method, a wide range of gas supply pressures may be directly accommodated by the compressor. At the limit of very high gas supply pressures, where the supply gas is routed directly into final compression cylinder 16, the compressor effectively acts like a single-stage compressor.

Based on the gas pressure sensed at inlet 14, valves 32, 34, 36, and 38 may be closed and opened manually or, automatically, via electronic controller 42.

Following the receipt of supply gas from gas inlet 14, the compression cylinder compresses the gas. The gas is serially compressed until it leaves final compression cylinder 16 and travels to gas outlet 18. If the compressor is operating with one or more of the lower stages "skipped" in this manner, then while the compressor is running, the cylinders of the skipped compression stages may be deactivated, or may be allowed to run with no gas movement and only minor frictional losses.

While a four cylinder gas compressor is exemplified in FIG. 1, one of ordinary skill in the art would read these descriptions understanding that as few as two cylinders or more than four cylinders may be used. Generally, providing more cylinders allows gas to be serially compressed to a higher pressure than would be possible with fewer cylinders.

In the implementation shown in FIG. 1, the cylinders operate in series, such that after a cylinder compresses the gas, the gas moves to the next cylinder for further compression. In this implementation, each compression cylinder corresponds to a different compression stage. However, in other implementations two or more of the cylinders may be arranged in parallel, i.e., multiple cylinders compress a gas to a single lower pressure and the gas then moves to another set of multiple compression cylinders (or a single compression cylinder) for further compression, or is routed directly to the gas outlet.

While each compression cylinder in FIG. 1 is in fluid communication with gas inlet 14, in some implementations fewer compression cylinders, e.g., just cylinders 12 and 20, or 12, 20 and 22, are in fluid communication with gas inlet 14. Such a configuration may be used, for example, if design inlet pressure at gas inlet 14 would never exceed the design outlet pressure of cylinder 22 so that there would be no occasion to route supply gas directly to the remaining cylinder(s).

While a valve disposed between the gas inlet 14 and each of the compression cylinders is exemplified in FIG. 1, one of ordinary skill in the art would understand that two or more of these valves may be replaced with a single multi-way valve. The single multi-way valve may supply gas from gas inlet 14 to one of the compression cylinders depending on the pressure of the supply gas. Multi-way valves are available commercially, for example, an EZ Series Aluminum multi-way valve available from VERSA® Products Co., Inc. (Paramus, N.J.).

While natural gas compression is exemplified, other gases such as air or hydrogen may also be compressed using this system.

If used to compress natural gas, the inlet pressure may typically be from 1 psig to 30 psig, from 1 psig to 50 psig, from 30 psig to 50 psig, from 1 to 100 psig, from 50 psig to 100 psig, from 1 psig to 200 psig, from 50 psig to 200 psig, greater than 10 psig, greater than 20 psig, greater than 30 psig, greater than 40 psig, greater than 50 psig, greater than 100 psig, or greater than 200 psig. Initial compression cylinder 12 may have a maximum inlet pressure of 1 psig, 2 psig, 4 psig, 10 psig, 20 psig, 30 psig, 40 psig, 50 psig, 100 psig, 200 psig, or 300 psig. Final compression cylinder 16 may have a maximum inlet pressure of 500 psig, 750 psig, 1000 psig, 2000 psig, 3000 psig, 4000 psig, 5000 psig, 6000 psig, or 10,000 psig. If used to compress other gases, these values may be higher or lower depending on the needs of the particular application.

The pressure ratio or the increase in the pressure of the gas when compressed by a compression cylinder may be at least 3, at least 5, from 3 to 5, and from 3 to 10. The pressure ratio is a design characteristic often chosen by the compressor engineer to optimize various criteria, including energy efficiency, operating environment, type of heat exchangers used between stages (if any), mechanical strength of the compressor components, valve design and temperature tolerance. The pressure ratio for each cylinder may be designed such that the load on the crankcase is the same for each cylinder piston. For compressing natural gas, the gas outlet pressure may typically be from 500 psig to 5000 psig. For compressing other gases, such as air or hydrogen, these outlet pressures may range from 100 psig to over 10,000 psig.

Other Embodiments

In some implementations, the compressor may be the internal combustion engine of a vehicle, with a modified cylinder head such that the plurality of compression cylinders as described above may be run as combustion cylinders during operation of the vehicle such that all the cylinders of the engine are providing power. Such "on-board" dual-mode compression systems are described in U.S. Pat. No. 9,528,465, the entire disclosure of which is incorporated by reference herein.

The present invention is not to be limited in scope by the specific embodiments described herein. Indeed, various modifications of the invention in addition to those described herein will be apparent to those skilled in the art from the foregoing description. Such modifications are intended to fall within the scope of the appended claims.

All references cited herein, including all patents, published patent applications, and published scientific articles and books, are incorporated by reference in their entireties for all purposes.

What is claimed is:

1. A gas compressor, comprising:

(a) a plurality of compression cylinders in fluid communication with each other, configured to compress a gas in at least two gas compression stages, including an initial compression cylinder in fluid communication with a gas inlet and a final compression cylinder in fluid communication with a gas outlet, wherein at least two compression cylinders of the plurality of compression cylinders which are from different gas compression stages (i) are in fluid communication with the gas inlet such that a supply gas can travel from the gas inlet to each of the at least two compression cylinders without first passing through the other(s) of the at least two compression cylinders and (ii) have different maximum inlet pressures; and (b) one or more valves disposed between and in direct fluid communication with the gas inlet and the at least two compression cylinders to deliver gas from the gas inlet to only a single stage at one time;

the one or more valves adapted to close such that no gas flows into the at least two compression cylinders;

the supply gas having an inlet pressure at the gas inlet; and the one or more valves adapted to open allowing flow to a corresponding compression cylinder of the at least two compression cylinders, that has a maximum inlet pressure greater than or equal to the inlet pressure of the supply gas, to route the supply gas from the gas inlet to the corresponding compression cylinder of the at least two compression cylinders, that has a maximum inlet pressure greater than or equal to the inlet pressure of the supply gas.

2. The gas compressor of claim 1, wherein each compression cylinder of the plurality of compression cylinders corresponds to a different compression stage.

3. The gas compressor of claim 1, wherein each of the compression cylinders of the plurality of compression cylinders is in fluid communication with the gas inlet.

4. The gas compressor of claim 1, wherein the plurality of compression cylinders is part of an internal combustion engine.

5. The gas compressor of claim 4, wherein the internal combustion engine further comprises at least one engine combustion cylinder to drive the plurality of compression cylinders and a common crankshaft coupling the at least one engine combustion cylinder and the plurality of compression cylinders.

6. The gas compressor of claim 1, further comprising a cylinder head including a check valve system to regulate a flow of the gas into and out of the compression cylinders.

7. A method of delivering gas to a gas compressor comprising:

providing the gas compressor comprising:

(a) a plurality of compression cylinders in fluid communication with each other, configured to compress a gas in at least two gas compression stages, including an initial compression cylinder in fluid communication with a gas inlet and a final compression cylinder in fluid communication with a gas outlet, wherein at least two compression cylinders of the plurality of compression cylinders which are from different gas compression stages (i) are in fluid communication with the gas inlet such that a supply gas can travel from the gas inlet to each of the at least two compression cylinders without first passing through the other(s) of the at least two compression cylinders and (ii) and the compression cylinders have different maximum inlet pressure; and (b) one or more valves disposed between and in direct fluid communication with the gas inlet and the at least two compression cylinders to deliver gas from the gas inlet to only a single stage at one time;

closing the one or more valves such that no gas flows into the at least two compression cylinders;

providing a supply gas having an inlet pressure at the gas inlet; and opening a valve of the one or more valves corresponding to a compression cylinder of the at least two compression cylinders, that has a maximum inlet pressure greater than or equal to the inlet pressure of the supply gas, to route the supply gas from the gas inlet to the compression cylinder of the at least two compression cylinders, that has a maximum inlet pressure greater than or equal to the inlet pressure of the supply gas.

8. The method of claim 7, wherein the valve that is opened causes the supply gas to skip compression in the initial compression cylinder.

9. The method of claim 8, wherein the supply gas is routed to the final compression cylinder.

10. The method of claim 9 further comprising deactivating each of the at least two compression cylinders that the supply gas skips compression in the at least two compression cylinders.

11. The method of claim 7, wherein closing the one or more valves and opening the valve of the one or more valves corresponding to the compression cylinder of the at least two compression cylinders, that has a maximum inlet pressure greater than or equal to the inlet pressure of the supply gas, is performed automatically.

12. The method of claim 7 further comprising compressing the supply gas.

13. The method of claim 7, wherein the inlet pressure is from 1 psig to 30 psig.

14. The method of claim 7, wherein the initial compression cylinder has a maximum inlet pressure of 50 psig.

15. The method of claim 7, wherein the final compression cylinder has a maximum inlet pressure of 6000 psig.

16. The method of claim 7, wherein the pressure ratio of the gas for a single stage of the at least two gas compression stages is from 3 to 10.

17. The method of claim 7, wherein the gas outlet pressure is from 500 psig to 5000 psig.

18. The method of claim 7, wherein the delivered gas is natural gas, air or hydrogen.

* * * * *